United States Patent [19]

Marmo

[11] 4,162,961

[45] Jul. 31, 1979

[54] CYCLE OIL CONVERSION PROCESS

[75] Inventor: Joseph F. Marmo, Pittsburgh, Pa.

[73] Assignee: Gulf Research & Development Company, Pittsburgh, Pa.

[21] Appl. No.: 570,066

[22] Filed: Apr. 21, 1975

Related U.S. Application Data

[63] Continuation-in-part of Ser. No. 393,894, Sep. 4, 1973, abandoned.

[51] Int. Cl.[2] ..... C10G 39/00

[52] U.S. Cl. ..... 208/57; 208/60

[58] Field of Search ..... 208/57, 60, 144

[56] References Cited

U.S. PATENT DOCUMENTS

| | | | |
|---|---|---|---|
| 2,958,643 | 11/1960 | Friedman | 208/60 |
| 3,071,536 | 1/1963 | Stiles et al. | 208/60 |
| 3,210,264 | 10/1965 | Haney | 208/79 |
| 3,364,132 | 1/1968 | Schoenfeld | 208/60 |
| 3,535,226 | 10/1970 | Jaffe | 208/60 |

*Primary Examiner*—Herbert Levine

[57] ABSTRACT

A cycle oil is hydrogenated under conditions such that the product of the hydrogenation process can be fractionated to obtain a more valuable naphtha reforming charge stock and a furnace oil fraction.

7 Claims, 1 Drawing Figure

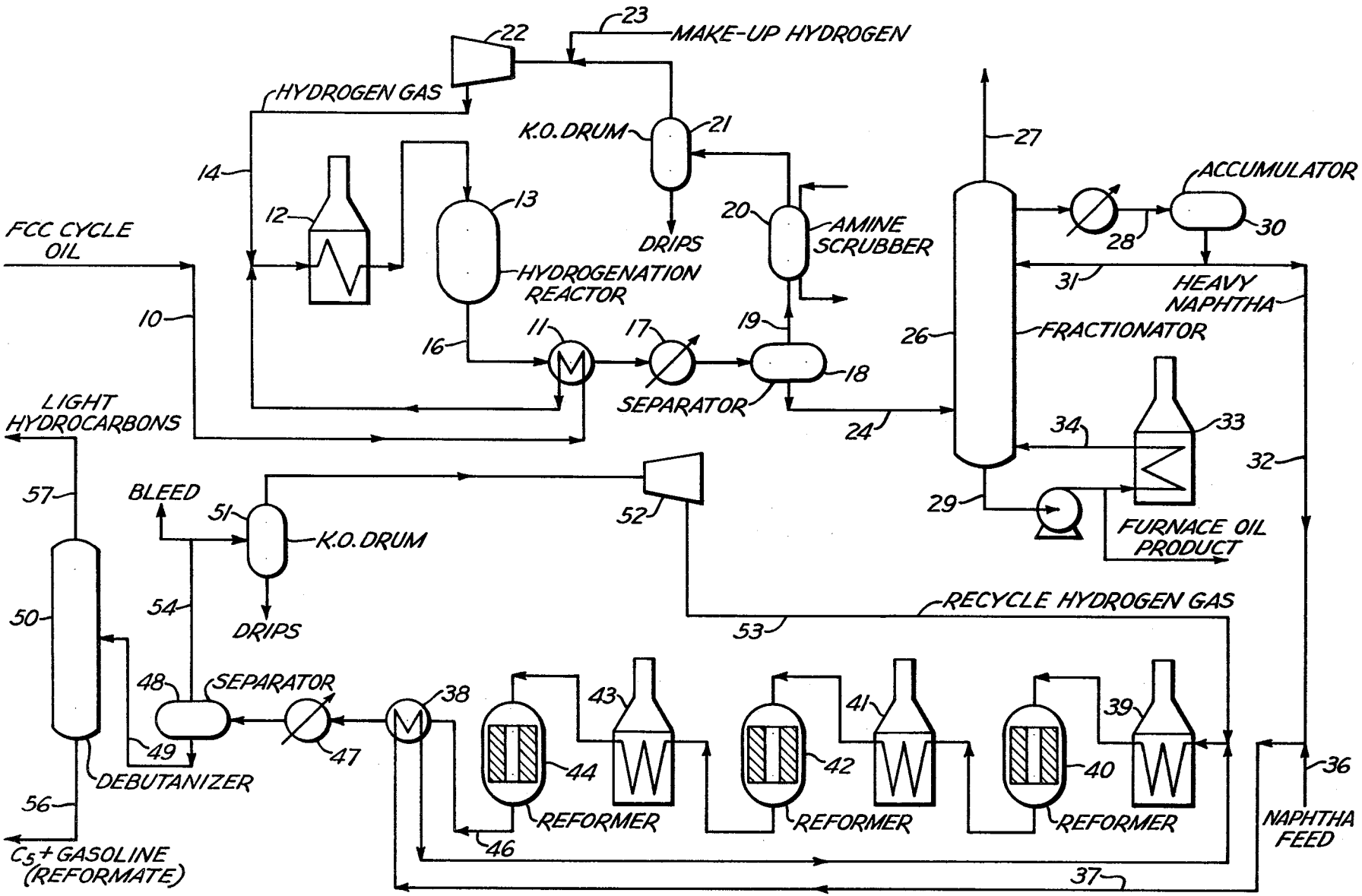
ACCUMULATOR
HEAVY NAPHTHA
FRACTIONATOR
FURNACE OIL PRODUCT
NAPHTHA FEED
RECYCLE HYDROGEN GAS
REFORMER
REFORMER
REFORMER
REFORMER
MAKE-UP HYDROGEN
AMINE SCRUBBER
K.O. DRUM
DRIPS
HYDROGENATION REACTOR
SEPARATOR
HYDROGEN GAS
K.O. DRUM
DRIPS
SEPARATOR
DEBUTANIZER
BLEED
FCC CYCLE OIL
LIGHT HYDROCARBONS
C5+ GASOLINE (REFORMATE)

CYCLE OIL CONVERSION PROCESS

CROSS REFERENCE TO RELATED APPLICATION

This application is a continuation-in-part of application Ser. No. 393,894, filed Sept. 4, 1973, now abandoned, which is incorporated herein by reference thereto.

BACKGROUND OF THE INVENTION

Conventionally, heavy petroleum fractions such as gas oils, vacuum gas oils, coker gas oils, and the like, have been advantageously cracked in the presence of a catalyst to produce lower boiling petroleum fractions including a high octane gasoline fraction. Conventionally, catalytic cracking units are operated at conditions so that a fraction or fractions boiling at a temperature above the distillation range of gasoline are also recovered from the catalytic cracking zone. The gasoline and lower boiling materials are conventionally separated by fractionation from such higher boiling product fractions.

Typically, a fraction recovered from a catalytic cracking process boiling higher than the gasoline fraction is identified as a cycle oil which can comprise light and heavy cycle oils and a slurry oil. The heavy cycle oil and slurry oil are normally recycled to the catalytic reaction zone. The refractory light cycle oil fraction due to the high polynuclear aromatic content thereof cannot be economically recycled to the catalytic reaction zone.

SUMMARY OF THE INVENTION

A highly aromatic cycle oil is converted into more valuable naphtha and furnace oil fractions by contacting the cycle oil with a suitable catalyst under controlled hydrogenation conditions, and thereafter the hydrogenation product is fractionated to obtain a furnace oil product fraction and a naphtha fraction which is charged to a reforming process.

DESCRIPTION OF THE DRAWING

The drawing is a schematic representation of one embodiment of the inventive process.

DESCRIPTION OF THE INVENTION

The inventive process is applicable to cycle oils containing at least 65 volume percent aromatics and obtained by the catalytic cracking of heavy petroleum fractions such as gas oils, employing either a synthetic or natural zeolitic catalyst. Typically, the cycle oil employed in the process of this invention will have properties as shown below in Table I.

TABLE I

| | |
|---|---|
| API Gravity | 10–25 |
| Distillation Range (ASTM D 86) | 350°–750° F. (177°–399° C.) |
| Sulfur, Weight % | 0.2–3 |
| Nitrogen, PPM | 500–3,000 |
| Aromatics, Volume % | 75–95 |

The catalyst employed in the hydrogenation process of this invention comprises a metal of Group VI-B and a metal of Group VIII composited with an alumina support. Especially effective catalysts are those containing nickel and tungsten as hydrogenation components. Other catalysts found to be effective include those containing nickel, cobalt and molybdenum, nickel and molybdenum, and cobalt and molybdenum. The hydrogenating components of such catalysts can be employed in the sulfide or unsulfided form.

Although the hydrogenation components indicated above can be employed in any proportions with each other, an especially effective catalyst are those in which the hydrogenation components are those in the group consisting of oxides and sulfides comprising (a) a combination of 5–25 percent by weight of a Group VI-B metal and (b) 5–20 percent by weight of a Group VIII metal. The hydrogenating components can be composited with a porous alumina support. The alumina support is normally shaped in the form of granules, pellets or balls, prior to compositing the hydrogenating metals therewith.

Conventionally, in the preparation of the catalyst composite, the hydrogenation component such as tungsten can be deposited on the support from an aqueous solution of the salt. After filtering and drying, the impregnate can be calcined to convert it into the oxide. The carrier can then be treated with an aqueous solution of the iron group metal such as a nickel salt, followed by calcining. If a second iron group metal is employed, the second iron group metal can also be deposited simultaneously with the first iron group metal or in a subsequent impregnation step. Nitrates or acetates of the iron group metals are normally utilized, although any other water soluble salt which leaves no harmful residue can be employed.

Calcining of the catalyst composite can be conducted by heating in air at a temperature of 800°–1600° F. (427°–827° C.). When a sulfided catalyst is desired, the catalyst prepared as described above can be treated in a known manner with hydrogen sulfide or preferably a mixture of hydrogen and hydrogen sulfide. Typically, the catalyst composite can be presulfided after calcination, or calcination and reduction, prior to contact with the cycle oil charge stock, by contacting with a sulfiding mixture of hydrogen and hydrogen sulfide. Normally, the sulfiding can be conducted at a temperature in the range of 500°–700° F. (260°–371° C.) at atmospheric or elevated pressures. Presulfiding can be conveniently effected at the beginning of an onstream period at the same conditions to be employed at the start of the hydrogenation process. The exact proportions of hydrogen and hydrogen sulfide employed in the sulfiding process are not critical and mixtures containing low or high concentrations of hydrogen sulfide can be used. Relatively low concentrations are preferred for economical reasons. Elemental sulfur or sulfur compounds, such as mercaptans, can be used in lieu of hydrogen sulfide.

As employed wherein the term "hydrogenation" describes the hydrogen treatment of the cycle oil feed to affect substantially complete saturation of the aromatics contained therein. The hydrogenation reaction is conducted with a catalyst having limited ring scission activity so as not to affect the extensive and somewhat random breakdown of molecules obtained in hydrocracking processes. Accordingly, the hydrogenation reaction is conducted so as to obtain a product wherein at least 75 volume percent of the product has a boiling range substantially the same as the boiling range of the cycle oil feed to the hydrogenation process step.

The hydrogenation reaction effected pursuant to the process of this invention can be conducted at a temperature in the range of 600°–800° F. (315°–427° C.), preferably in the range of 625°–725° F. (329°–384° C.). A hydrogen partial pressure in the range of 1000–4000 psia (70.5 to 282 kgs/cm$^2$), preferably in the range of 2000–3000 psia (141–212 kgs/cm$^2$) can be employed in the hydrogenation zone. Hydrogen-containing gas can be circulated to the hydrogenation zone at a rate in the range of 5000–10000 standard cubic feet per barrel of charge (896–792 liters of gas per liter of charge) with the hydrogen purity varying from 60 to about 100 volume percent. The hydrogenation reaction is conducted at a liquid hourly space velocity in the range of 0.1–5.

The hydrogenation reaction can be continuously conducted in the presence of the catalyst composite in the liquid phase. Hydrogen can be separated from the hydrogenation reaction effluent and recycled to the hydrogenation zone. It may be necessary to provide for bleeding off a portion of the recycled gas and to make up hydrogen in order to maintain the hydrogen purity within the range specified. If desired, the recycled gas can be washed with a chemical absorbent for hydrogen sulfide or otherwise treated in a conventional manner to reduce the hydrogen sulfide content thereof prior to recycling.

The liquid effluent withdrawn from the hydrogenation zone can be fractionated to obtain a naphtha fraction boiling in the range of 200°–425° F. (93°–218° C.) and a heavier furnace oil fraction. The fractionation step can be conducted in a conventional fractionator employing conventional process conditions. The naphtha fraction recovered from the fractionation zone will typically have an API gravity in the range of 30–40, the concentration of sulfur of less than 1 part per million (ppm) and a concentration of nitrogen of less than 1 ppm. The naphtha fraction will be comprised of greater than 80 percent by volume of naphthenes, less than 20 percent by volume of paraffins and aromatics and less than 1 percent by volume of olefins.

The naphtha fraction containing a large concentration of bi-cyclo paraffins is then passed as feed to a reforming process to obtain a high octane gasoline blending component. Although not to be limited thereto, if the naphtha fraction is charged to a typical semi-regenerative reforming process, the naphtha fraction can be blended with the normal pretreated charge to the reforming process. In those instances where continuous reforming or cyclic reforming processes are desired, the naphtha fraction can comprise the entire charge or be blended with the normal pretreated charge stock passed to the reforming process unit.

Conventional reforming process conditions are employed in the reforming zone. When, for example, employing conventional platinum-alumina or multi-metallic reforming catalysts, such as the platinum-rhenium-alumina catalyst, reforming inlet temperatures are normally in the range of 900°–1000° F. (493°–638° C.) in the reforming reaction zone. Reforming total pressures in the range of 50 psig to 1000 psig (3.5 to 70.2 kgs/cm$^2$), and a space velocity in the range of 0.5 to 4.0 (volume of feed per hour volume of catalyst) are normally employed in the reforming zone. The hydrogen to hydrocarbon feed molal ratio for the reforming process will normally range from 1 to 5 for use with multimetallic catalysts to about 13 for conventional catalysts.

The furnace oil fraction recovered from the hydrogenation zone effluent can be employed in the blending of fuel oil compositions or as a feed to a catalytic cracking process. Typically, the furnace oil fraction will have a distillation range from about 380° F. (193° C.) to about 540° F. (282° C.) and will be comprised essentially of saturated hydrocarbons.

Referring to the drawing the invention will hereafter be illustrated by describing a specific embodiment. A cycle oil feed recovered from a fluid catalytic cracking process is passed via conduit 10, heat exchange means 11, and furnace 12 to a hydrogenation reactor 13. Here, the cycle oil feed is characterized as follows:

| | | |
|---|---|---|
| Gravity, °API (ASTM D 287) | 17.6 | |
| Distillation, °F. (ASTM D 86) | | |
| Over Point | 359 | (181° C.) |
| 10% condensed | 433 | (222° C.) |
| 30 | 454 | (234° C.) |
| 50 | 469 | (242° C.) |
| 70 | 485 | (251° C.) |
| 90 | 510 | (266° C.) |
| End Point | 579 | (303° C.) |
| Sulfur, ppm | 9,800 | |
| Nitrogen, ppm | 109 | |
| Hydrocarbon Type, Volume % | | |
| Aromatics | 88.5 | |
| Olefins | 1.2 | |
| Saturates | 10.3 | |

Hydrogen gas flowing through conduit 14 is combined with the cycle oil feed to furnace 12 and hydrogenation reactor 13 as illustrated.

Hydrogenation reactor 13 contains a fixed catalyst bed of a catalyst comprising 6.0 weight percent nickel, 19.0 weight percent tungsten on an alumina support. The gas is passed to reactor 13 at the rate of 8,374 standard cubic feet per barrel of recycle oil feed with the hydrogen concentration of the gas being 83.8 volume percent. A temperature of 729° F. (387° C.) and an average reactor pressure of 2,500 psig (176 kgs/cm$^2$) is maintained within reactor 13. The cycle oil is passed through reactor 13 at the rate of 0.75 volume of feed per hour per volume of catalyst. Hydrogen consumption in the hydrogenation reactor is 3,043 standard cubic feet per barrel of cycle oil feed for this case.

The effluent from the hydrogenation reactor 13 is passed via conduit 16, heat exchange means 11 and heat exchange means 17, wherein the effluent is cooled, to a separator 18. Within separator 18 the hydrogen-containing gas is separated from the effluent mixture and can be recycled to hydrogenation reactor 13 via conduit 19, an amine scrubber 20, knockout drum 21, compressor 22, and conduit 14. As previously described in the specification, make-up hydrogen can be added via conduit 23 as required. Liquid is withdrawn from separator 18 via conduit 24 and passed to a fractionator 26. The liquid feed to fractionator 26 is characterized as follows:

| | | |
|---|---|---|
| Gravity, °API (ASTM D 287) | 34.3 | |
| Distillation, °F. (ASTM D 86) | | |
| Over Point | 366 | (186° C.) |
| 10% condensed | 386 | (197° C.) |
| 30 | 403 | (206° C.) |
| 50 | 415 | (212° C.) |
| 70 | 429 | (220° C.) |
| 90 | 461 | (238° C.) |
| End Point | 540 | (282° C.) |
| Sulfur, ppm | 4 | |
| Nitrogen, ppm | <0.2 | |
| Hydrocarbon Type, Volume % | | |
| Aromatics | 11 | |
| Olefins | 2 | |

-continued

| | |
|---|---|
| Saturates | 87 |

Within fractionator 26, the feed is separated into a light fraction boiling below 300° F. (149° C.) which is withdrawn from the top fractionator 26 via conduit 27, a heavy naphtha fraction which is withdrawn from an upper region of fractionator 26 via conduit 28, and a residual furnace oil fraction which is withdrawn from the bottom of fractionator 26 via conduit 29. As illustrated, the heavy naphtha fraction is cooled and passed to an accumulator 30. A portion of the heavy naphtha fraction can be recycled to fractionator 26 via conduit 31. The remainder of the heavy naphtha fraction is passed to a reforming process, as hereafter described via conduit 32. As illustrated, a portion of the furnace oil fraction withdrawn from fractionator 26 can be heated in a furnace 33 and recycled via conduit 34 to fractionator 26.

The naphtha fraction flowing through conduit 32 and the furnace oil fraction recovered from fractionator 26 via conduit 29 are characterized as follows:

| | Naphtha Fraction | | Furnace Oil | |
|---|---|---|---|---|
| Gravity, °API (ASTM D 287) | 38.7 | | 34.0 | |
| Distillation, °F. ASTM D 86) | | | | |
| Over Point | 289 | (142° C.) | 392 | (200° C.) |
| 10% condensed | 317 | (158° C.) | 408 | (209° C.) |
| 30 | 334 | (168° C.) | 417 | (213° C.) |
| 50 | 347 | (174° C.) | 425 | (218° C.) |
| 70 | 361 | (182° C.) | 440 | (227° C.) |
| 90 | 379 | (192° C.) | 477 | (247° C.) |
| End Point | 407 | (208° C.) | 531 | (277° C.) |
| Sulfur, ppm | <1 | | — | |
| Nitrogen, ppm | 0.2 | | — | |
| Hydrocarbon Type, Volume % | | | | |
| Aromatics | 9 | | 13 | |
| Olefins | 1 | | 1 | |
| Saturates | 90 | | 86 | |

As previously discussed the naphtha fraction withdrawn from fractionator 26 can be combined with an additional naphtha feed introduced to the reforming process via conduit 36. The straight-run naphtha feed introduced via conduit 36 and the blend of the straight-run naphtha and heavy naphtha fractions (7.37 volume percent heavy naphtha) is characterized as follows:

| | Straight Run Naphtha | Blend of Straight Run Naphtha and Heavy Naphtha |
|---|---|---|
| API Gravity | 57.6 | 56.1 |
| Distillation, °F. (ASTM D 86) | | |
| 10% | 227 (108° C.) | 242 (117° C.) |
| 30% | 236 (113° C.) | 249 (120° C.) |
| 50% | 245 (118° C.) | 257 (124° C.) |
| 70% | 253 (122° C.) | 269 (131° C.) |
| 90% | 285 (140° C.) | 300 (149° C.) |
| Hydrocarbon Type, Vol. % | | |
| Paraffins | 48.4 | 44.7 |
| Naphthenes | 41.1 | 44.7 |
| Aromatics | 10.5 | 10.6 |
| Sulfur, ppm | <1 | <1 |
| Nitrogen, ppm | <0.5 | <0.5 |

As illustrated, the reforming process is comprised of three reforming stages conducted in reformer reactors 40, 42 and 44 with the feed to each stage being preheated by furnaces 39, 41 and 43, respectively. Hydrogen gas flowing through conduit 53 is combined with the blended feed flowing through conduit 37. In this example, each of reformer reactors 40, 42 and 44 contain a fixed catalyst bed comprising a platinum-rhenium-alumina catalyst.

An average reactor pressure of 250 psig (17.6 kgs./cm$^2$) is maintained in the reforming reaction zone. A hydrogen to hydrocarbon molal ratio of 5 to 1 is maintained in the feed passed to reformer reactor 40. A weighted average reactor inlet temperature of 950° F. (510° C.) is maintained in the reformer reaction zone and a space velocity of 2.0 volumes of feed per hour per volume of catalyst is maintained in this case. The hydrogen concentration of the recycled gaseous stream flowing through conduit 53 is 88.3 mol percent.

The reformate effluent is passed from reformer reactor 44 via conduit 46, heat exchange means 38, and heat exchange means 47, wherein the effluent is cooled, to a conventional separator 48. Within separator 48, a gaseous stream containing hydrogen is separated from the effluent and a portion recycled via conduit 54, knockout drum 51, compressor 52 and conduit 53 to furnace 39. The liquid separated from the gaseous stream is withdrawn from separator 48 via conduit 49 and passed to a debutanizer 50.

Within debutanizer 50, the feed mixture is fractionated to obtain a light hydrocarbon stream withdrawn from debutanizer 50 via conduit 57, and a $C_5$+ gasoline reformate product withdrawn from debutanizer 50 via conduit 56. The $C_5$+ reformate yield is 83.0 volume percent on liquid charge to the reformer. The clear research octane number of the debutanized reformate product is 98.0. 1,270 standard cubic feet of hydrogen is produced in the reforming process per barrel of liquid feed.

Although the invention has been described with reference to specific embodiments, references, and details, various modifications and changes will be apparent to one skilled in the art and are contemplated to be embraced in this invention.

I claim:

1. A process which comprises contacting a feed consisting essentially of cycle oil and containing at least 65 volume percent aromatics with a hydrogenation catalyst in a hydrogenation zone under hydrogenation conditions, such hydrogenation catalyst comprising a metal of Group VI-B and a metal of Group VIII composited with an alumina support, recovering a furnace oil fraction from the hydrogenation zone effluent, recovering a naphtha fraction from said hydrogenation effluent, passing said recovered naphtha fraction to a reforming zone containing a reforming catalyst, maintaining reforming conditions within said reforming zone, and recovering a reformate product from said reforming zone.

2. The process of claim 1 wherein said hydrogenation conditions include a temperature in the range of 600°–800° F., a hydrogen partial pressure in the range of 1000–4000 psia, a liquid hourly space velocity in the range of 0.1 to 5, and a hydrogen-containing gas circulation rate in the range of 5000–10,000 standard cubic feet per barrel of cycle oil charge.

3. The process of claim 2 wherein said Group VI metal comprises tungsten and said Group VIII metal comprises nickel.

4. The process of claim 3 wherein said reforming conditions include a temperature in the range of 900°-1000° F., an average reforming pressure in the range of 50 psig to 1000 psig, a liquid hourly space velocity in the range of 0.5 to 4.0, and a hydrogen to hydrocarbon feed molal ratio for the reforming process in the range of 1 to about 13.

5. The process of claim 3 wherein said naphtha fraction has a boiling range of from about 200° to about 425° F.

6. The process of claim 5 wherein said cycle oil has an ASTM D 86 distillation range from about 350° to about 750° F.

7. A process which comprises contacting a feed consisting essentially of cycle oil and containing at least 65 volume percent aromatics with a hydrogenation catalyst in a hydrogenation zone under hydrogenation conditions which include a temperature in the range of 600°-800° F., a hydrogen partial pressure in the range of 1,000-4,000 psia, a liquid hourly space velocity in the range of 0.1 to 5, and a hydrogen-containing gas circulation rate in the range of 5,000-10,000 standard cubic feet per barrel of cycle oil, said hydrogenation catalyst comprising a metal of Group VI-B and a metal of Group VIII composited with an alumina support, recovering a furnace oil fraction from the hydrogenation zone effluent, recovering a naphtha fraction from said hydrogenation zone effluent, passing said naphtha fraction in combination with a straight-run naphtha to a reforming zone containing a reforming catalyst, maintaining reforming conditions within said reforming zone, and recovering a reformate product from said reforming zone.

* * * * *